US006976534B2

(12) United States Patent
Sutton et al.

(10) Patent No.: US 6,976,534 B2
(45) Date of Patent: Dec. 20, 2005

(54) SLIP ELEMENT FOR USE WITH A DOWNHOLE TOOL AND A METHOD OF MANUFACTURING SAME

(75) Inventors: Mike H. Sutton, Katy, TX (US); Donald W. Winslow, Duncan, OK (US); Donald R. Smith, Wilson, OK (US); Don S. Folds, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 164 days.

(21) Appl. No.: 10/673,818

(22) Filed: Sep. 29, 2003

(65) Prior Publication Data

US 2005/0069691 A1 Mar. 31, 2005

(51) Int. Cl.[7] ..... E21B 23/00
(52) U.S. Cl. ..... 166/134; 166/118; 175/423
(58) Field of Search ..... 166/117.7, 118, 166/138, 206; 175/230, 420, 423

(56) References Cited

U.S. PATENT DOCUMENTS

| | | | | |
|---|---|---|---|---|
| 4,533,004 | A * | 8/1985 | Ecer | 175/430 |
| 4,708,202 | A * | 11/1987 | Sukup et al. | 166/123 |
| 5,224,540 | A | 7/1993 | Streich et al. | 166/118 |
| 5,271,468 | A * | 12/1993 | Streich et al. | 166/387 |
| 5,390,737 | A | 2/1995 | Jacobi et al. | 166/184 |
| 5,540,279 | A | 7/1996 | Branch et al. | 166/118 |
| 5,701,959 | A | 12/1997 | Hushbeck et al. | 166/387 |
| 5,839,515 | A * | 11/1998 | Yuan et al. | 166/387 |
| 5,984,007 | A * | 11/1999 | Yuan et al. | 166/134 |
| 6,220,349 | B1 | 4/2001 | Vargus et al. | 166/138 |
| 6,378,606 | B1 * | 4/2002 | Swor et al. | 166/217 |

* cited by examiner

*Primary Examiner*—Frank Tsay
(74) *Attorney, Agent, or Firm*—John W. Wustenberg; Haynes & Boone, LLP

(57) ABSTRACT

A slip element and a method of manufacturing same according to which two or more inserts are placed in corresponding openings formed in a body member. The material forming the insert in one of the openings is stronger than the material forming the insert in another of the openings.

32 Claims, 3 Drawing Sheets

SLIP ELEMENT FOR USE WITH A DOWNHOLE TOOL AND A METHOD OF MANUFACTURING SAME

BACKGROUND

This invention relates to a slip element for use in connection with a downhole tool for use in wellbores in oil and gas recovery operations.

In the drilling or reworking of oil wells, it is often desirable to seal casing, or seal tubing or other pipes in the casing, to isolate a zone in the casing, and, to this end, downhole sealing tools, such as bridge plugs, frac plugs; and packers are utilized. These tools typically employ a slip assembly consisting of a plurality of slip elements mounted on a mandrel, or the like, that are initially retained in close proximity to the mandrel but are forced outwardly away from the mandrel upon the tool being set to engage, or grip, the inner wall of the casing. This locates and secures the tool in the wellbore so that sealing, and other wellbore operations, may be performed.

Some of these slip elements are made with cast iron so that they will readily grip the inner wall of the casing when expanded. However, these cast iron slip elements are relatively heavy and, as a result, have often been replaced with composite slip elements fabricated, at least in part, of a relatively lightweight plastic material. However, the composite slip elements often cannot properly grip the inner casing wall. Therefore, ceramic inserts, or buttons, have been placed in the composite slip elements to bite into the inner casing wall to assist in the gripping action discussed above. Another advantage of the ceramic inserts is that when the tool is no longer needed, the ceramic inserts are easy to drill or mill out with the slip elements when the tool is to be destructively removed from the wellbore. However, the ceramic inserts tend to chip, especially when they are set in the casing, which can compromise the gripping action of the slip elements.

Metallic inserts have been used in place of the ceramic inserts since they do not chip. However, when the tool is to be removed from the wellbore, it is often drilled or milled out, and it is often difficult to drill or mill out the metallic inserts.

Thus, there remains a need in the art for a cost-effective slip assembly that includes inserts that grip the casing wall, yet resist chipping and can easily be drilled or milled out.

DETAILED DESCRIPTION

Figure 1:
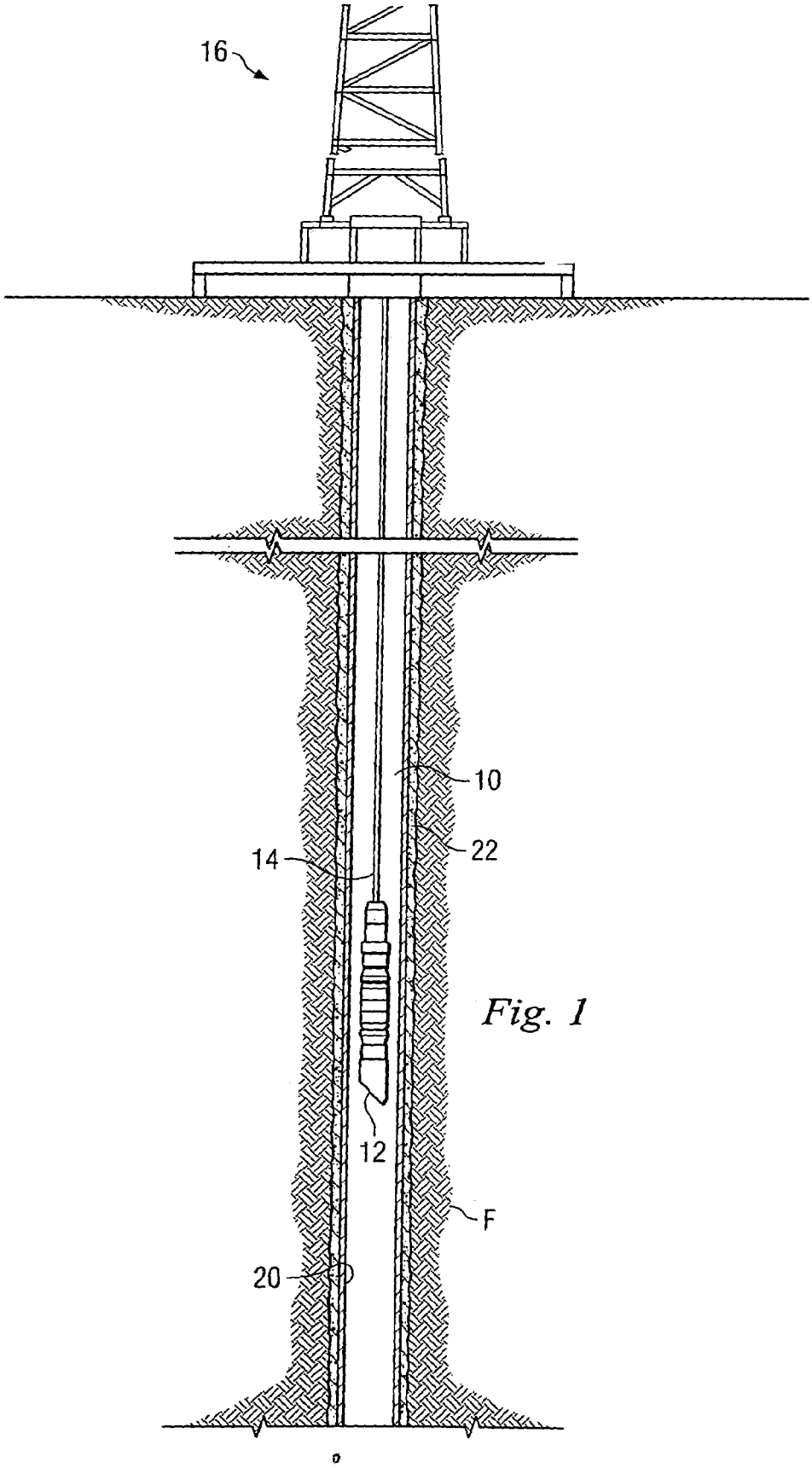
FIG. 1 is a diagrammatic view of a downhole tool employing a slip assembly according to an embodiment of the present invention shown inserted in a wellbore.

Referring to FIG. 1, the reference numeral 10 refers to a wellbore penetrating a subterranean formation F for the purpose of recovering hydrocarbon fluids from the formation F. To this end, and for the purpose of carrying out a sealing operation to be described, a tool 12 is lowered into the wellbore 10 to a predetermined depth by a string 14, in the form of coiled tubing, jointed tubing, wireline, or the like, that is connected to the upper end of the tool 12. The tool 12 is shown generally in FIG. 1 and will be described in detail later.

The string 14 extends from a rig 16 that is located above ground and extends over the wellbore 10. The rig 16 is conventional and, as such, includes support structure, a motor driven winch, or the like, and other associated equipment for receiving and supporting the tool 12 and lowering it to a predetermined depth in the wellbore 10 by unwinding the string 14 from the winch.

The upper portion of the wellbore 10 may be lined with a casing 20 which is cemented in the wellbore 10 by introducing cement 22 in an annulus formed between the inner surface of the wellbore 10 and the outer surface of the casing 20, all in a conventional manner.

Figure 2:
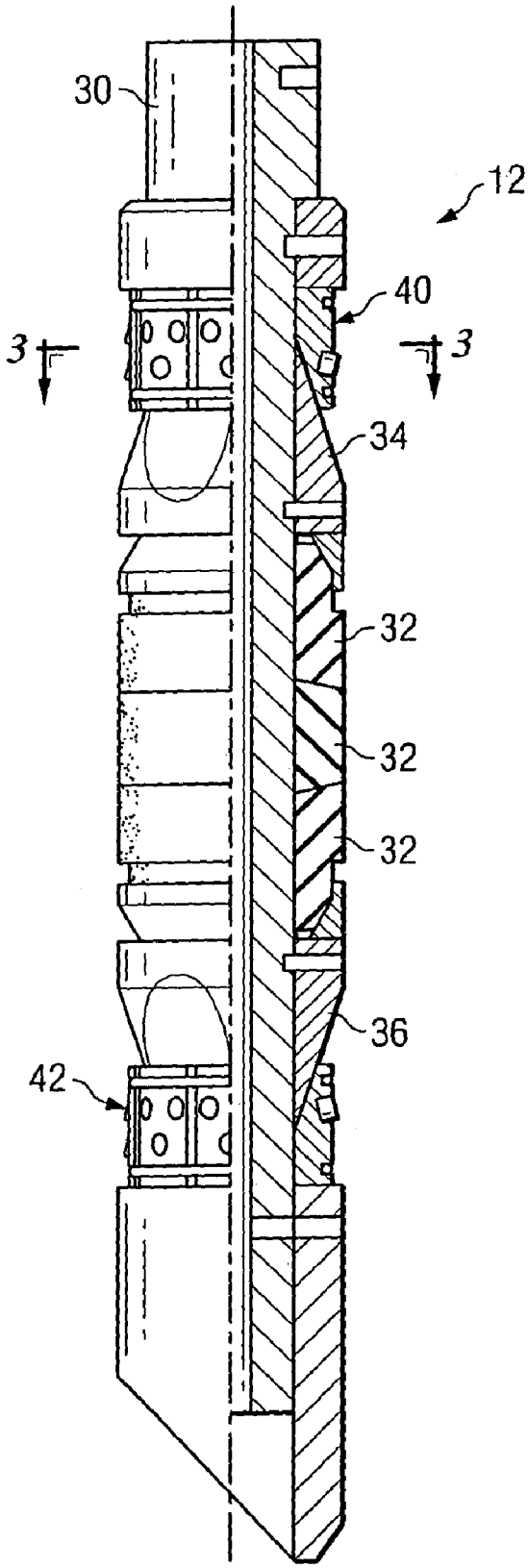
FIG. 2 is a cross-sectional view of the tool of FIG. 1.

Referring to FIG. 2, the tool 12 can be in the form of a bridge plug, a frac plug, or a packer and, as such, includes an elongated tubular mandrel 30 having several components secured to its outer surface in any conventional manner. These components include a plurality of axially spaced packer elements 32 which are angularly spaced around the circumference of the mandrel 30 and are connected to the mandrel 30 in any conventional manner. A pair of wedges 34 and 36 are mounted on the mandrel 30 in any conventional manner and in an axially spaced relation to the packer elements 32. Assuming the wellbore 10, and therefore the mandrel 30, extend vertically, or substantially vertically, the wedge 34 extends above the packer elements 32 and the wedge 36 extends below the packer elements 32. The inner surfaces of the packer elements 32 and the wedges 34 and 36 are curved to conform to the curvature of the mandrel 30, and the outer surfaces of the wedges 34 and 36 are tapered outwardly in a direction towards the packer elements 32.

A slip assembly 40 is mounted on the mandrel 30 above the wedge 34 and a slip assembly 42 is mounted on the mandrel 30 below the wedge 36. The slip assemblies 40 and 42 will be described in detail. Other components are provided on the mandrel 30 but will not be described since they form no part of the invention.

Figure 3A:
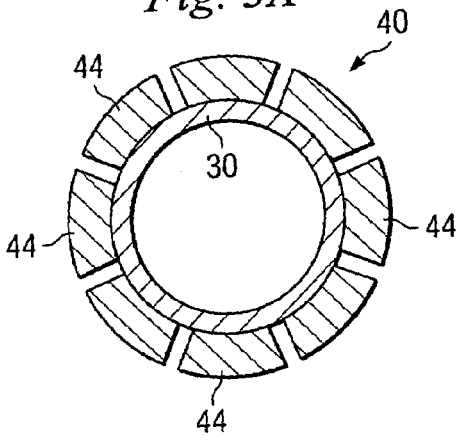
FIG. 3A is a cross-sectional view taken along the line 3—3 of FIG. 2.

As shown in FIG. 3A, the slip assembly 40 consists of eight spaced, arcuate slip elements 44 angularly spaced around the circumference of the mandrel 30. Each slip element 44 is in the form of a body member having a curved inner surface to conform to the curvature of the mandrel 30 and a lower tapered end portion in engagement with the tapered portion of the wedge 34 (FIG. 2).

Figure 3B:
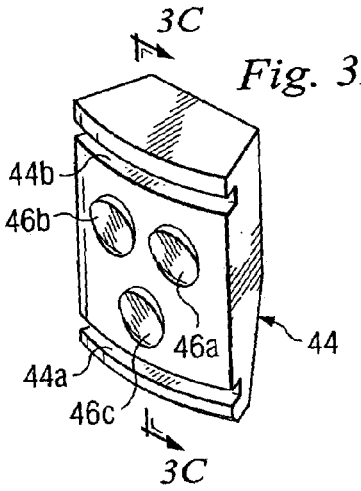
FIG. 3B is an isometric view of a slip element of FIG. 3A.

One of the slip elements 44 is shown in FIG. 3B and has two spaced grooves, or notches, 44*a* and 44*b*, formed in its outer surface for receiving retaining rings, or the like, to secure the slip element 44 to the mandrel 30. A plurality of buttons, or inserts, 46*a*, 46*b*, and 46*c* are provided in corresponding openings formed in the outer surface of each slip element 44. Each insert 46*a*, 46*b*, and 46*c* is in the form of a solid cylinder, or rod, and is secured in its respective opening in any conventional manner. In the example shown in FIG. 3B, the inserts 46*a* and 46*b* are horizontally aligned and horizontally spaced to form a horizontal row extending just above the insert 46*c*. As better shown in FIG. 3C, an end portion of each insert 46*a*, 46*b*, and 46*c* projects outwardly from the outer surface of the slip element 44 and extends downwardly at a slight angle to the horizontal, or transverse, axis of the slip element 44.

Each slip element 44 is fabricated from a relatively light and inexpensive material, such as a composite matrix consisting of epoxy resin polymers and a glass fiber reinforcement. The inserts 46*a* and 46*b* are fabricated from a material, such as ceramic, that is stronger than the material of the slip elements 44 and is strong enough to enable the inserts 46*a* and 46*b* to grip the inner wall of the casing 20 (FIG. 1) when set, yet can be drilled or milled out when it is desired to remove the tool 12 from the wellbore 10.

The insert 46*c* consists of a material, such as a metallic ceramic composite, that is stronger than that of the above-mentioned ceramic material forming the inserts 46*a* and 46*b*, and is strong enough to enable the insert 46*c* to grip the inner wall of the casing 20 yet will not be as susceptible to chipping as the inserts 46*a* and 46*b*. Thus, the insert 46*c* absorbs forces and loads on all of the inserts 46*a*, 46*b*, and 46*c* that otherwise would cause the inserts 46*a* and 46*b* to chip and thus become dysfunctional. Moreover, the provision of only one insert 46*c* of a metallic ceramic composite associated with each slip element 44 does not significantly impair the ability of the slip elements 44 to be milled or drilled out when it is desired to remove the tool 12 from the wellbore 10.

Figure 3C:
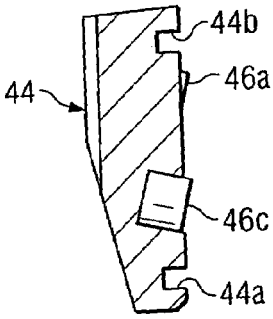
FIG. 3C is a cross-sectional view taken along the line 3C—3C of FIG. 3B.

It is understood that the remaining slip elements 44 of the slip assembly 40, as well as all of the slip elements of the slip assembly 42, are identical to the slip element 44 shown in FIGS. 3B and 3C and have inserts that are identical to, and are located in the same manner as, the inserts 46*a*, 46*b*, and 46*c*.

When the tool 12 is lowered to a predetermined depth in the casing 20 (FIG. 1) for the purpose of establishing a seal with the inner wall of the casing 20, the slip assemblies 40 and 42 are set in a conventional manner so that the inserts 46*a*, 46*b*, and 46*c* of the slip assembly 40, as well as the corresponding inserts of the slip assembly 42, move into engagement with the inner wall of the casing 20 (FIG. 1) to grip the latter wall and secure the tool 12 in the casing 20.

Figure 4A:
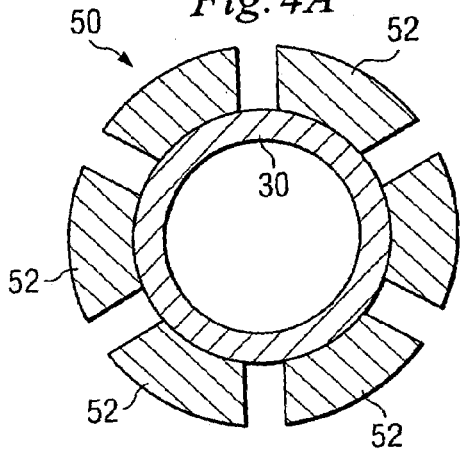
FIGS. 4A–4C are views similar to those of FIGS. 3A–3C, respectively, but depict an alternate embodiment of the slip element.
Figure 4B:
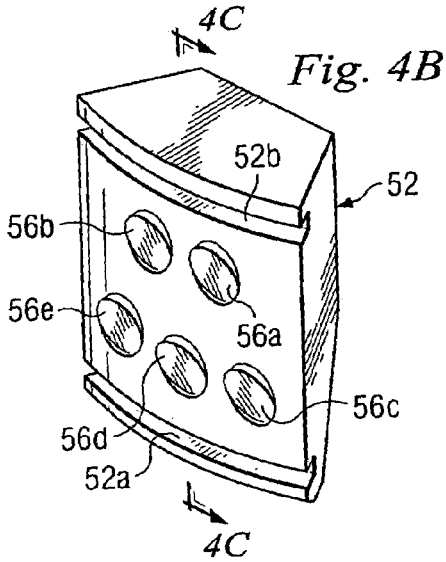
Figure 4C:
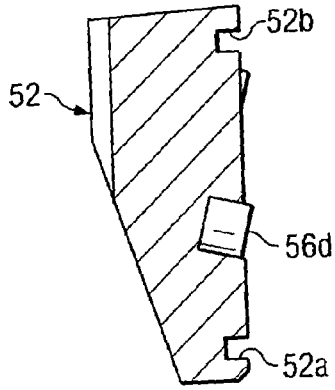

According to the embodiment of FIGS. 4A–4C, the slip assembly 40 is replaced by a slip assembly 50 and the components shown in FIGS. 1 and 2 are otherwise the same. The slip assembly 50 consists of six spaced, arcuate slip elements 52 angularly spaced around the circumference of the mandrel 30. Each slip element 52 has a curved inner surface to conform to the curvature of the mandrel 30 and a lower tapered end portion that engages the tapered portion of the wedge 34 (FIG. 2).

One of the slip elements 52 is shown in FIG. 4B and has two spaced grooves, or notches, 52*a* and 52*b* formed in its outer surface for receiving retaining rings, or the like, to secure the slip elements 52 to the mandrel 30. A plurality of buttons, or inserts 56*a*, 56*b*, 56*c*, 56*d* and 56*e* are provided in corresponding openings formed in the outer surface of each slip element 52, and each insert 56*a*, 56*b*, 56*c*, 56*d* and 56*e* is in the form of a solid cylinder, or rod, secured in the respective opening in any conventional, manner. The inserts 56*a* and 56*b* are horizontally aligned and horizontally spaced to form a horizontal row extending just above a horizontal row formed by the inserts 56*c*, 56*d*, and 56*e*. As shown in FIG. 4C, each insert 56*a*, 56*b*, 56*c*, 56*d*, and 56*e* projects outwardly from the outer surface of the slip element 52 and extends downwardly at a slight angle to the horizontal, or transverse, axis of the slip element 52.

Each slip element 52 is fabricated from a relatively light and inexpensive material, such as a composite matrix consisting of epoxy resin polymers and a glass fiber reinforcement. The inserts 56*a* and 56*b* are fabricated from a material, such as ceramic, that is stronger than the material of the slip elements 52 and is strong enough to enable the inserts 56*a* and 56*b* to grip the inner wall of the casing 20 (FIG. 1) when set, yet be drilled or milled out when it is desired to remove the tool 12 from the wellbore 12.

Each insert 56*c*, 56*d*, and 56*e* consists of a material, such as a metallic ceramic composite, that is stronger than that of the above-mentioned ceramic material forming the inserts 56*a* and 56*b*, and is strong enough to enable the inserts 56*c*, 56*d*, and 56*e* to grip the inner wall of the casing 20 yet will not be as susceptible to chipping as the inserts 56*a* and 56*b*. Thus, the inserts 56*c*, 56*d*, and 56*e* absorb forces and loads on all of the inserts 56*a*, 56*b*, 56*c*, 56*d*, and 56*e* that otherwise would cause the inserts 56*a* and 56*b* to chip and thus become dysfunctional. Moreover, the provision of only three inserts 56*c*, 56*d*, and 56*e* of a metallic ceramic composite associated with each slip element 52 does not significantly impair the ability of the slip elements 52 to be milled or drilled out when it is desired to move the tool 12 in the wellbore 10.

It is understood that the remaining slip elements 52 of the slip assembly 50 are identical to the slip element 52 shown in FIGS. 4B and 4C, and that the lower slip assembly 42 of the previous embodiment can also be replaced by the slip assembly 50.

When the tool 12 is lowered to a predetermined depth in the casing 20 (FIG. 1) for the purpose of establishing a seal with the inner wall of the casing 20, the slip assemblies 50 are set in a conventional manner so that the inserts 56*a*, 56*b*, 56*c*, 56*d*, and 56*e* move into engagement with the inner wall of the casing 20 (FIG. 1) to grip the latter wall and secure the tool 12 in the casing 20. It is understood that the above-mentioned lower slip assembly functions in the same manner.

VARIATIONS

1. The number of slip elements can vary and could be in the form of one continuous ring.
2. The shape of the slip elements can vary and, for example, could be conical with or without a flat bottom.
3. The slip elements can be made of other materials, such as cast iron.
4. The shape and size of the inserts can be varied.
5. The number of relatively strong inserts, such as the insert 46*c* of the embodiment of FIG. 3A–3C, utilized in each slip can be varied based on the time allotted for drilling or milling out the slip elements after use.
6. The number of relatively strong inserts, such as the insert 46*c* of the embodiment of FIG. 3A-3C and/or the number of relatively weak inserts, such as the inserts 46*a* and 46*b* of the latter embodiment, can be varied, as well as the ratio of these numbers.
7. The particular location and pattern of the inserts in each slip element can be varied.
8. The material forming the inserts 46*a*, 46*b*, 56*a*, and 56*b* is not limited to ceramic and the material forming the inserts 46*c* and 56*c*, 56*d*, and 56*e* is not limited to a metallic ceramic composite. Rather, these materials can be varied as long as all of the inserts grip the casing wall, as long as the material of the insert 46*c* is more chip resistant than material of the inserts 46*a* and 46*b*; and as long as the material of the inserts 56*c*, 56*d*, and 56*e* is more chip resistant than the material of the inserts 56*a* and 56*b*, and as long as all of the inserts 46*a*, 46*b*, 46*c*, 56*a*, 56*b*, 56*c*, 56*d*, and 56*e* can be drilled or milled out. For example, the material of the inserts 46*c*, 56*c*, 56*d*, and 56*e* could be made of steel, cast iron, or of a non-metallic material.

9. The slip assemblies 40 and 50 can be used on the same tool.

10. Spatial references, such as "upper", "lower", "vertical", "angular", etc. are for the purpose of illustration only and do not limit the specific orientation or location of the structure described above.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

What is claimed is:

1. A slip element comprising:

a body member;

at least one insert provided in a corresponding opening in the body member and being fabricated from a ceramic material; and at least one insert provided in a corresponding opening in the body member and being fabricated from a metallic/ceramic composite material.

2. The slip element of claim 1 wherein each insert is in the form of a solid cylinder or rod.

3. The slip element of claim 1 wherein an end portion of each insert projects outwardly from an outer surface of the body member.

4. The slip element of claim 1 wherein each insert extends at an angle to the transverse axis of the body member.

5. The slip element of claim 1 wherein the material forming each insert is strong enough to enable each insert to grip the wall of a casing.

6. The slip element of claim 5 wherein each insert is adapted to be drilled out when the slip element is to be removed from the casing.

7. The slip element of claim 1 wherein the metallic/ceramic composite material is stronger than the ceramic material.

8. The slip element of claim 1 wherein the insert formed of the metallic/ceramic composite material is not as susceptible to chipping as the insert formed of the ceramic material; and wherein the insert formed of the ceramic material can be milled easier than the insert formed of the metallic/ceramic composite material.

9. The slip element of claim 7 wherein the material forming the body member comprises a composite matrix.

10. The slip element of claim 9 wherein the composite matrix comprises epoxy resin polymers and a glass fiber reinforcement.

11. The slip element of claim 1 wherein the inserts are stronger than the body member.

12. The slip element of claim 1 wherein the slip element is adapted to be attached to a mandrel, and the body member has a curved inner surface to conform to the curvature of the mandrel.

13. The slip element of claim 12 wherein the slip element has a lower tapered end portion adapted to engage a tapered portion of a wedge mounted on the mandrel.

14. The slip element of claim 12 wherein the slip element has at least one groove formed in its outer surface for receiving a retaining member to retain the slip element on the mandrel.

15. A method comprising the steps of:

providing a body member;

fabricating at least one insert from a ceramic material;

inserting the insert in a corresponding opening in the body member;

fabricating at least one additional insert from a metallic/ceramic composite material; and inserting the additional insert in a corresponding opening in the body member.

16. The method of claim 15 further comprising the step of moving the body member towards the inner wall of a casing so that the inserts grip the wall.

17. The method of claim 15 further comprising the step of drilling the body member and the inserts out to enable them to be removed from the casing.

18. The method of claim 15 wherein the metallic/ceramic composite material is stronger than the ceramic material.

19. The method of claim 18 wherein the insert formed of the metallic/ceramic composite material is not as susceptible to chipping as the insert formed of the ceramic material; and wherein the insert formed of the ceramic material can be milled easier than the insert formed of the metallic/ceramic composite material.

20. The method of claim 15 further comprising the step of fabricating the body member with a composite matrix.

21. The method of claim 15 wherein the inserts are stronger than that of the body member.

22. The method of claim 15 further comprising the steps of:

mounting the body member to a mandrel; and curving the inner surface of the body member to conform to the curvature of a mandrel.

23. The method of claim 22 further comprising the step of tapering an end portion of the body member so that it can engage a tapered portion of a wedge mounted on the mandrel.

24. The method of claim 22 further comprising the step of forming at least one groove in the outer surface of the body member for receiving a retaining member to retain the body member on the mandrel.

25. A slip element comprising:

a body member; and at least two inserts provided in corresponding openings in the body member, one of the inserts being less susceptible to chipping than the other insert; and the other insert being more millable than the one insert.

26. The element of claim 25 wherein the one insert is fabricated from a metallic/ceramic composite material and wherein the other insert is fabricated from a ceramic material.

27. The slip element of claim 25 wherein each insert is in the form of a solid cylinder or rod.

28. The slip element of claim 25 wherein an end portion of each insert projects outwardly from an outer surface of the body member.

29. The slip element of claim 25 wherein each insert extends at an angle to the transverse axis of the body member.

30. The slip element of claim 25 wherein the material forming each insert is strong enough to enable each insert to grip the wall of a casing.

31. The slip element of claim 25 wherein each insert is adapted to be drilled out when the slip element is to be removed from the casing.

32. The slip element of claim 25 wherein material forming the one insert is stronger that the material forming the other insert.

* * * * *